US009441507B2

(12) United States Patent
Kanai

(10) Patent No.: US 9,441,507 B2
(45) Date of Patent: Sep. 13, 2016

(54) VALVE TIMING CONTROL APPARATUS

(75) Inventor: Hiroshi Kanai, Susono (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 0 days.

(21) Appl. No.: 14/370,602

(22) PCT Filed: Jan. 12, 2012

(86) PCT No.: PCT/JP2012/050496
§ 371 (c)(1),
(2), (4) Date: Jul. 3, 2014

(87) PCT Pub. No.: WO2013/105247
PCT Pub. Date: Jul. 18, 2013

(65) Prior Publication Data

US 2014/0352639 A1 Dec. 4, 2014

(51) Int. Cl.

| | |
|---|---|
| ***F01L 1/34*** | (2006.01) |
| ***F01L 1/344*** | (2006.01) |
| *F02D 41/00* | (2006.01) |
| *F02D 13/02* | (2006.01) |

(52) U.S. Cl.
CPC ..... *F01L 1/344* (2013.01); *F01L 1/3442* (2013.01); *F01L 1/34409* (2013.01); *F01L 2001/3445* (2013.01); *F01L 2001/34453* (2013.01); *F02D 13/0203* (2013.01); *F02D 2041/001* (2013.01)

(58) Field of Classification Search
CPC .. F02D 41/04; F02D 13/02; F02D 2041/001; F01L 1/356; F01L 1/344; Y02T 10/18
USPC ..... 123/90.15, 90.17
See application file for complete search history.

(56) References Cited

U.S. PATENT DOCUMENTS

| | | | | |
|---|---|---|---|---|
| 7,478,614 | B2 * | 1/2009 | Nakamura et al. | 123/90.15 |
| 2002/0166522 | A1 | 11/2002 | Takahashi et al. | |
| 2003/0200944 | A1 | 10/2003 | Takahashi et al. | |
| 2004/0244746 | A1 | 12/2004 | Kinugawa | |
| 2006/0266311 | A1 * | 11/2006 | Fujii | 123/90.15 |
| 2010/0224153 | A1 * | 9/2010 | Ichimoto et al. | 123/90.17 |

FOREIGN PATENT DOCUMENTS

| | | | |
|---|---|---|---|
| JP | 2002-332874 | A | 11/2002 |
| JP | 2003-314311 | A | 11/2003 |
| JP | 2004-360606 | A | 12/2004 |
| JP | 2011-117379 | A | 6/2011 |

* cited by examiner

*Primary Examiner* — Zelalem Eshete
(74) *Attorney, Agent, or Firm* — Kenyon & Kenyon LLP

(57) ABSTRACT

A valve timing control apparatus is provided with at least one of: an advance-angle control starting device configured to start to control a relative rotational phase of a camshaft with respect to a crankshaft to an advance side when an internal combustion engine starts and when a valve lift amount associated with an intake valve or an exhaust valve increases; and a delay-angle control starting device configured to start to control the relative rotational phase to a delay side when the internal combustion engine starts and when the valve lift amount associated with the intake valve or the exhaust valve decreases. It is possible to appropriately release engagement by a locking mechanism between a first rotating body configured to rotate synchronously with the camshaft and a second rotating body configured to rotate synchronously with the crankshaft.

3 Claims, 5 Drawing Sheets

VALVE TIMING CONTROL APPARATUS

CROSS-REFERENCE TO RELATED APPLICATIONS

This is a national phase application based on the PCT International Patent Application No. PCT/JP2012/050496 filed Jan. 12, 2012, the entire contents of which are incorporated herein by reference.

TECHNICAL FIELD

The present invention relates to a valve timing control apparatus configured to change opening/closing timing of at least one of an intake valve and an exhaust valve of an internal combustion engine.

BACKGROUND ART

As this type of apparatus, for example, there is proposed an apparatus provided with an actuator having a locking mechanism which is connected to a camshaft, which is configured to change a relative phase of the camshaft with respect to a crankshaft with in a predetermined change range, and which is to set the relative phase at a locking position. Particularly, here, it is disclosed that an unlock mode for releasing a lock pin of the locking mechanism is performed if oil pressure of the lock pin is predicted from the number of engine revolutions and an elapsed time from the start of an engine and if it is determined that the oil pressure has sufficiently increased (refer to Patent document 1).

Alternatively, there is proposed a valve timing adjusting apparatus which is provided with: a first rotating body; a second rotating body; and a lock pin configured to restrict relative rotation between the first rotating body and the second rotating body, and which is configured not to flow oil to a retard chamber until the restriction of the first rotating body and the second rotating body by the lock pin is completely released (refer to Patent document 2).

Alternatively, there is proposed a technology in a valve timing adjusting apparatus provided with: a vane rotor configured to rotate with a camshaft; a housing configured to rotate relatively with the vane rotor; and a locking mechanism configured to regulate the relative rotation between the vane rotor and the housing, wherein oscillation between the housing and the vane rotor is increased by increasing torque variation of the camshaft, causing the lock pin to be easily removed (refer to Patent document 3).

Alternatively, there is proposed a technology in a cam phase actuator provided with: a first rotating body configured to rotate synchronously with a crankshaft; a second rotating body fixed to the camshaft; and a locking mechanism configured to lock the second rotating body at a first relative angle with respect to the first rotating body, wherein lock pin release control is performed only upon advance-angle control if it is determined to be in a lock state, thereby reducing the delay of an advance-angle operation by the lock pin release control (refer to Patent document 4).

PRIOR ART DOCUMENT

Patent Document

Patent document 1: Japanese Patent Application Laid Open No. 2002-332874

Patent document 2: Japanese Patent Application Laid Open No. 2004-360606

Patent document 3: Japanese Patent Application Laid Open No. 2011-117379

Patent document 4: Japanese Patent Application Laid Open No. 2003-314311

SUMMARY OF INVENTION

Subject to be Solved by the Invention

By the way, when the internal combustion engine starts, the opening/closing of the intake valve and the exhaust valve is driven according to the rotation of the crankshaft. Then, torque caused by the opening/closing drive of at least one of the intake valve and the exhaust valve is applied to a variable valve timing mechanism via the camshaft. Thus, a sharing force acts on the lock pin due to the torque caused by the opening/closing drive of at least one of the intake valve and the exhaust valve, and this makes it hard to release the lock pin, which is technically problematic. In the aforementioned background art, it is extremely hard to solve this technical problem.

In view of the aforementioned problem, it is therefore an object of the present invention to provide a valve timing control apparatus configured to appropriately release the lock pin.

Means for Solving the Subject

The above object of the present invention can be solved by a valve timing control apparatus which is provided with a first rotating body configured to rotate synchronously with rotation of a camshaft which drives opening/closing of at least one of an intake valve and an exhaust valve of an internal combustion engine, and having a plurality of vanes, a second rotating body configured to rotate synchronously with rotation of a crankshaft of the internal combustion engine, and having a plurality of concave parts which correspond to the plurality of vanes, respectively, and which define respective movable ranges of the plurality of vanes, a locking mechanism configured to engage the first rotating body and the second rotating body with each other such that each of the plurality of vanes is in contact with one end of respective one of the concave parts, at least when the internal combustion engine stops, and a rotational phase changing device configured to control hydraulic pressure associated with a liquid chamber which is formed on a side of at least one of the corresponding vanes by dividing the plurality of concave parts by the corresponding vanes, respectively, thereby changing a relative rotational phase of the camshaft with respect to the crankshaft, said valve timing control apparatus is further provided with at least one of: an advance-angle control starting device configured to start to control the relative rotational phase to an advance side when the internal combustion engine starts and when a valve lift amount associated with the intake valve or the exhaust valve increases, and a delay-angle control starting device configured to start to control the relative rotational phase to a delay side when the internal combustion engine starts and when the valve lift amount associated with the intake valve or the exhaust valve decreases.

According to the valve timing control apparatus of the present invention, the valve timing control apparatus is provided with the first rotating body, the second rotating body, the locking mechanism, and the rotational phase changing device.

The first rotating body is, for example, a vane rotor or the like, and has the plurality of vanes. The first rotating body rotates synchronously with the rotation of the camshaft. The second rotating body is, for example, a housing or the like, and has the plurality of concave parts which correspond to the plurality of vanes of the first rotating body, respectively, and which define respective movable ranges of the plurality of vanes. The second rotating body rotates synchronously with the rotation of the crankshaft.

The locking mechanism engages the first rotating body and the second rotating body with each other such that each of the plurality of vanes of the first rotating body is in contact with one end of respective one of the concave parts of the second rotating body, at least when the internal combustion engine stops.

The rotational phase changing device is configured to control the hydraulic pressure (e.g. oil pressure) associated with the liquid chamber which is formed on the side of at least one of the corresponding vanes by dividing the plurality of concave parts of the second rotating body by the corresponding vanes of the first rotating body, respectively, thereby changing the relative rotational phase of the camshaft with respect to the crankshaft.

The valve timing control apparatus is further provided with at least one of: the advance-angle control starting device which is provided with, for example, a memory, a processor, and the like; and the delay-angle control starting device which is provided with, for example, a memory, a processor, and the like.

The advance-angle control starting device which is provided with, for example, a memory, a processor, and the like starts to control the relative rotational phase to the advance side when the internal combustion engine starts and when the valve lift amount associated with the intake valve or the exhaust valve increases (i.e. when the intake valve or the exhaust valve travels downward). The expression of "when the internal combustion engine starts" means a period between a cranking start time point or a time point a predetermined time before the cranking start time point (e.g. a time point at which a start request signal is transmitted) and complete explosion of the internal combustion engine.

The expression of " . . . starts to control the relative rotational phase to the advance side" means to start a series of control processing including processing required until the relative rotational phase actually starts to change to the advance side, such as, for example, releasing the engagement between the first rotating body and the second rotating body by the locking mechanism and ensuring necessary liquid pressure.

The delay-angle control starting device which is provided with, for example, a memory, a processor, and the like starts to control the relative rotational phase to the delay side when the internal combustion engine starts and when the valve lift amount associated with the intake valve or the exhaust valve decreases (i.e. when the intake valve or the exhaust valve travels upward). The expression of " . . . starts to control the relative rotational phase to the delay side" means to start a series of control processing including processing required until the relative rotational phase actually starts to change to the delay side, such as, for example, releasing the engagement between the first rotating body and the second rotating body by the locking mechanism and ensuring necessary liquid pressure.

Here, the study of the present inventor has revealed the following matter; namely, when the internal combustion engine starts, typically, the crankshaft is rotated before the engagement between the first rotating body and the second rotating body by the locking mechanism is released. The camshaft rotates in conjunction with the rotation of the crankshaft, and the opening/closing operation of the intake valve and the exhaust valve is performed in connection with the rotation of the camshaft. Then, the opening/closing operation of at least one of the intake valve and the exhaust valve causes torque variation on the camshaft, and a sharing force acts on a lock pin which constitutes the locking mechanism. There is a possibility that an influence of the sharing force makes it impossible or hard to release the engagement between the first rotating body and the second rotating body.

By the way, a cross sectional shape of a cam connected to the camshaft is, for example, oval or the like, and the magnitude of the sharing force acting on the lock pin thus periodically changes. Specifically, for example, if the relative rotational phase is changed to the advance side (i.e. in the case of so-called delay-angle locking in which the first rotating body and the second rotating body are engaged on the delay side), the magnitude of the sharing force acting on the lock pin becomes relatively small when the valve lift amount increases. On the other hand, if the relative rotational phase is changed to the delay side (i.e. in the case of so-called advance-angle locking in which the first rotating body and the second rotating body are engaged on the advance side), the magnitude of the sharing force acting on the lock pin becomes relatively small when the valve lift amount decreases.

Therefore, in the present invention, by the advance-angle control starting device, the control of the relative rotational phase to the advance side is started when the internal combustion engine starts and when the valve lift amount associated with the intake valve or the exhaust valve increases. On the other hand, by the delay-angle control starting device, the control of the relative rotational phase to the delay side is started when the internal combustion engine starts and when the valve lift amount associated with the intake valve or the exhaust valve decreases.

It is thus possible to release the engagement between the first rotating body and the second rotating body by the locking mechanism (i.e. to release the lock pin), relatively easily.

In the one aspect of the valve timing control apparatus of the present invention, the advance-angle control starting device starts to control the relative rotational phase to the advance side so as to release the engagement between the first rotating body and the second rotating body by the locking mechanism when the internal combustion engine starts and when the valve lift amount associated with the intake valve or the exhaust valve increases.

According to this aspect, it is possible to certainly release the lock pin, and it is extremely useful in practice. In addition, the relative rotational phase (or valve timing) can be changed, relatively quickly.

The study of the present inventor has revealed the following matter; namely, even if the control of the relative rotational phase to the advance side is started when the valve lift amount increases, there is a possibility that the lock pin release operation cannot be appropriately performed because the valve lift amount may start to decrease when the lock pin release operation is actually performed, for example, due to a time lag caused by mechanical friction or the like.

Thus, by such a configuration that the advance-angle control starting device is configured to start to control the relative rotational phase to the advance side so as to release the engagement between the first rotating body and the second rotating body by the locking mechanism when the valve lift amount increases, the lock pine of the locking mechanism can be certainly released.

In another aspect of the valve timing control apparatus of the present invention, the delay-angle control starting device starts to control the relative rotational phase to the delay side so as to release the engagement between the first rotating body and the second rotating body by the locking mechanism when the internal combustion engine starts and when the valve lift amount associated with the intake valve or the exhaust valve decreases.

According to this aspect, it is possible to certainly release the lock pin, and it is extremely useful in practice. In addition, the relative rotational phase can be changed, relatively quickly.

The operation and other advantages of the present invention will become more apparent from the embodiment explained below.

MODES FOR CARRYING OUT THE INVENTION

Hereinafter, an embodiment of the valve timing control apparatus of the present invention will be explained with reference to the drawings.

(Configuration of Engine)

Figure 1:
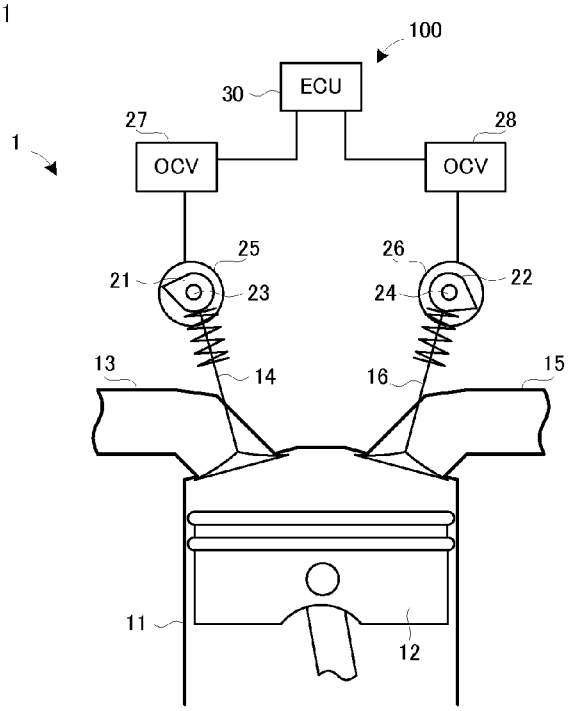
FIG. 1 is a block diagram illustrating a configuration of an engine in an embodiment.

A configuration of an engine in the embodiment will be explained with reference to FIG. 1. FIG. 1 is a block diagram illustrating the configuration of the engine in the embodiment.

In FIG. 1, an engine 1 as one example of the "internal combustion engine" of the present invention is provided with a cylinder 11, a piston 12, an intake passage 13, an intake valve 14, an exhaust passage 15, and an exhaust valve 16. In FIG. 1, the illustration of members which are not directly related to the present invention is omitted.

The engine 1 is further provided with (i) an intake-side variable valve timing (VVT) mechanism having a cam 21 configured to drive opening/closing of the intake valve 14, a camshaft 23 to which the cam 21 is connected, an actuator 25 coupled with the camshaft 23 and configured to change a rotation phase of the camshaft 23, and an oil control valve (OCV) 27 configured to supply oil pressure to the actuator 25; and (ii) an exhaust-side variable valve timing mechanism having a cam 22 configured to drive opening/closing of the exhaust valve 16, a camshaft 24 to which the cam 22 is connected, an actuator 26 coupled with the camshaft 24 and configured to change a rotation phase of the camshaft 24, and an oil control valve (OCV) 28 configured to supply oil pressure to the actuator 26.

An electronic control unit (ECU) 30 controls each of the oil control valves 27 and 28 according to the state of the engine 1 or the like.

(Configuration Intake Side Variable Valve Timing Mechanism)

Figure 2:
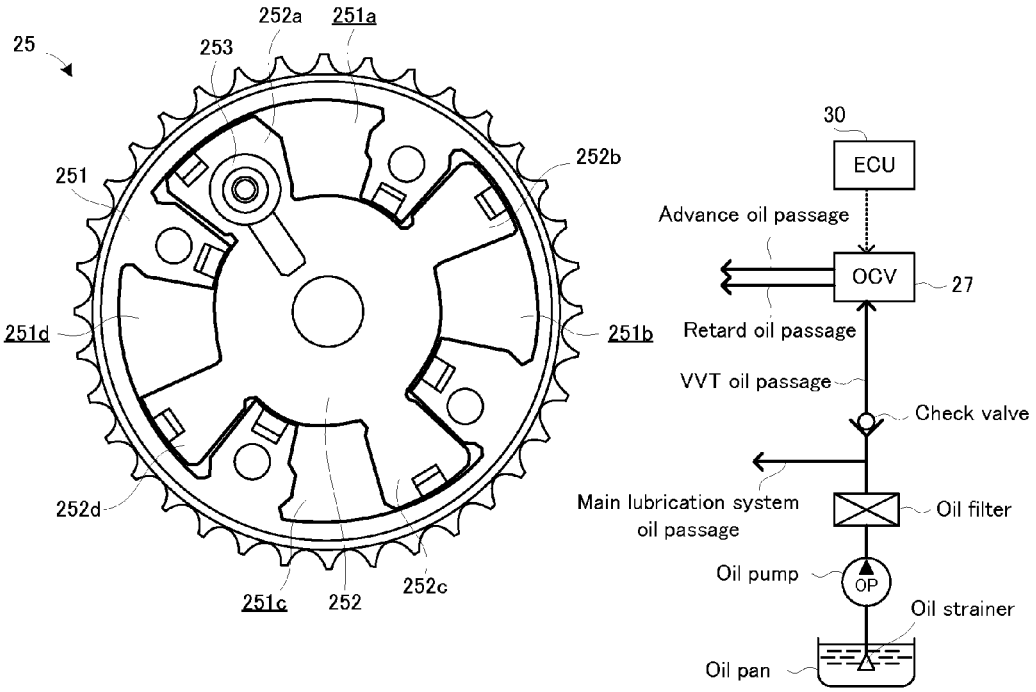
FIG. 2 is a diagram illustrating a main part of an intake-side variable valve timing mechanism in the embodiment.

Next, a configuration of the intake-side variable valve timing mechanism will be explained with reference to FIG. 2. FIG. 2 is a diagram illustrating a main part of the intake-side variable valve timing mechanism in the embodiment.

In FIG. 2, the actuator 25 is provided with a housing 251 configured to rotate synchronously with rotation of a crankshaft (not illustrated) of the engine 1, a vane rotor 252 configured to rotate synchronously with rotation of the camshaft 23, and a locking mechanism 253 configured to engage the housing 251 and the vane rotor 252 with each other at least when the engine 1 stops.

The housing 251 has a plurality of concave parts 251*a*, 251*b*, 251*c* and 251*d* which correspond to a plurality of vanes 252*a*, 252*b*, 252*c* and 252*d* of the vane rotor 252, respectively, and which define respective movable ranges of the plurality of vanes 252*a*, 252*b*, 252*c* and 252*d*.

Oil stored in an oil pan of the engine 1 is pumped up by an oil pump via an oil strainer, is filtered by an oil filter to remove a foreign body, and is then supplied to the oil control valve 27 via a check valve or non-return valve and a VVT oil passage.

The oil control valve 27 controls hydraulic pressure (or the oil pressure herein) associated with a liquid chamber (specifically, an advance chamber and a retard chamber) which is formed on the side of at least one of the corresponding vanes by dividing the plurality of concave parts 251*a*, 251*b*, 251*c* and 251*d* of the housing 251 by the corresponding vanes, respectively.

The supply of the oil to the actuator 25 by the oil control valve 27 changes a relative position between the housing 251 and the vane rotor 252, resulting in a change in relative rotational phase of the camshaft 23 with respect to the crankshaft. The amount of the oil supplied to the actuator 25 from the oil control valve 27 is determined on the basis of a VVT control signal outputted from the ECU 30.

The valve timing control apparatus 100 in the embodiment is provided with the actuator 25, the oil control valve 27, and the ECU 30. In the embodiment, namely, one portion of the functions of the ECU 30 for various electronic control of the engine 1 (and a vehicle in which the engine 1 is installed) is used as one portion of the valve timing control apparatus 100.

FIG. 2 illustrates that the housing 251 and the vane rotor 252 are engaged in a state in which the plurality of vanes 252*a*, 252*b*, 252*c* and 252*d* are adjusted at the most retarded position, by the locking mechanism 253.

When the engine 1 starts, the camshaft 23 is rotationally driven. Here, a cross sectional shape of the cam 21 is, for example, oval or the like, as illustrated in FIG. 3, and a relation between the direction of a force applied to the cam 21 by a valve spring of the intake valve 14 and the direction of rotation of the camshaft 23 thus periodically changes.

Figure 3:
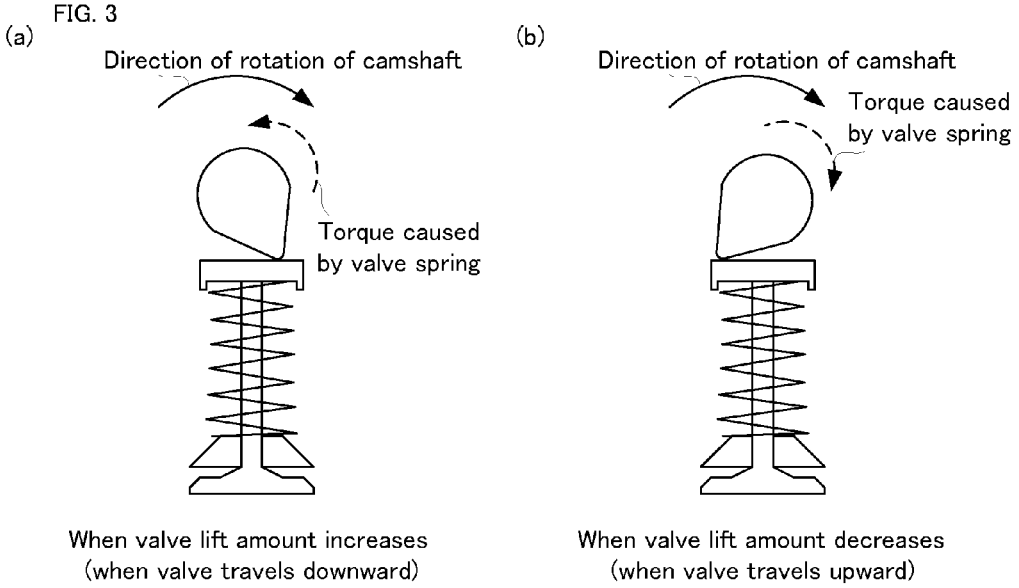
FIG. 3 are diagrams illustrating a relation between direction of rotation of a camshaft and torque caused by a valve spring in the embodiment.

Specifically, when a valve lift amount increases, the direction of rotation of the camshaft 23 and the direction of the force applied to the cam 21 by the valve spring are opposite to each other, as illustrated in FIG. 3(*a*). On the other hand, when the valve lift amount decreases, the direction of rotation of the camshaft 23 and the direction of the force applied to the cam 21 by the valve spring are equal to each other, as illustrated in FIG. 3(*b*).

FIG. 3 are diagrams illustrating the relation between the direction of rotation of the camshaft and torque caused by the valve spring in the embodiment.

By the way, when the engine 1 starts, the engagement between the housing 251 and the vane rotor 252 in the actuator 25 is released (i.e. a lock pin of the locking mechanism 253 is released).

Figure 4:
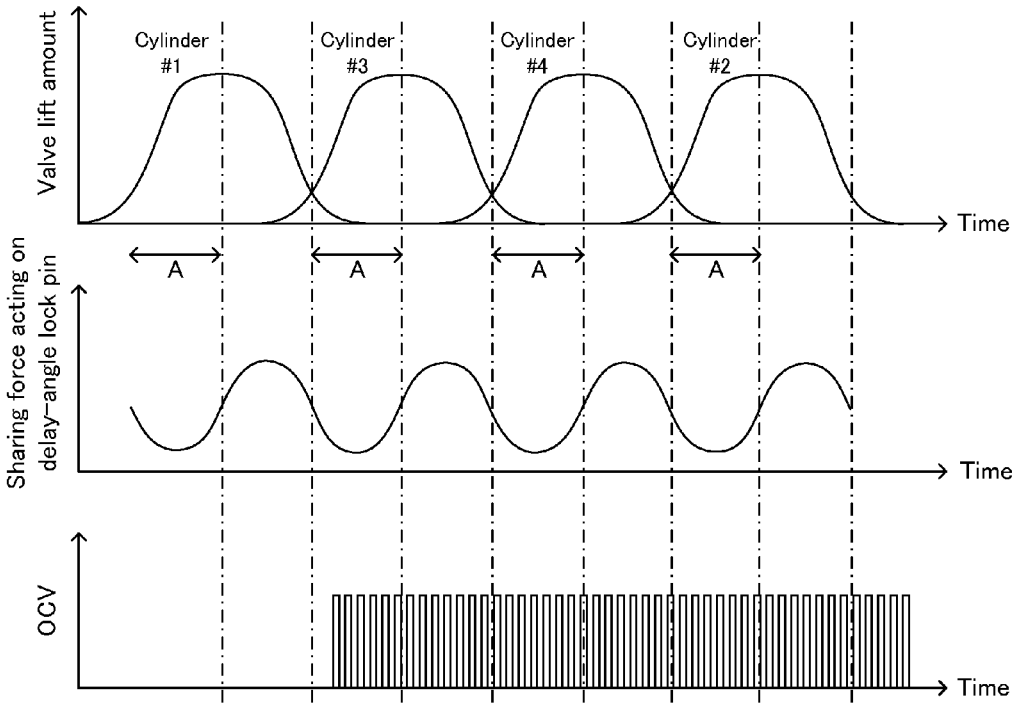
FIG. 4 is a diagram illustrating one example of time variation of a valve lift amount, and time variation of a sharing force acting on a delay-angle lock pin in the embodiment.

As described above, the relation between the direction of the force applied to the cam 21 by the valve spring of the intake valve 14 and the direction of rotation of the camshaft 23 periodically changes. As a result, the magnitude of a sharing force applied to the lock pin of the locking mechanism 253 periodically changes, as illustrated in FIG. 4. FIG. 4 is a diagram illustrating one example of time variation of the valve lift amount, and time variation of the sharing force acting on the delay-angle lock pin in the embodiment.

If the sharing force applied to the lock pin increases, oil pressure required to release the lock pin increases. On the other hand, if the sharing force applied to the lock pin decreases, the oil pressure required to release the lock pin decreases. It is therefore possible to release the lock pin, relatively easily, by performing the lock pin release processing when the sharing force applied to the lock pin is small.

Specifically, in a state in which the vanes and the housing are pressed to each other, the sharing force applied to the lock pin does not increase; however, in a state in which the vanes and the housing are to be separated, the lock pin is stuck and the sharing force increases. Thus, if the camshaft rotates in a state in which the housing 251 and the vane rotor 252 are engaged by the locking mechanism 253 (i.e. in a state in which the lock pin is not released), the sharing force periodically increases, as illustrated in FIG. 4.

The ECU 30 thus releases the lock pin when the valve lift amount increases, and controls the oil control valve 27 to start to control the relative rotational phase of the camshaft 23 with respect to the crankshaft to the advance side. Specifically, for example, the ECU 30 starts the output of a VVT advance-angle signal (refer to the lowest part in FIG. 4) to the oil control valve 27 in any of periods A in FIG. 4.

Figure 5:
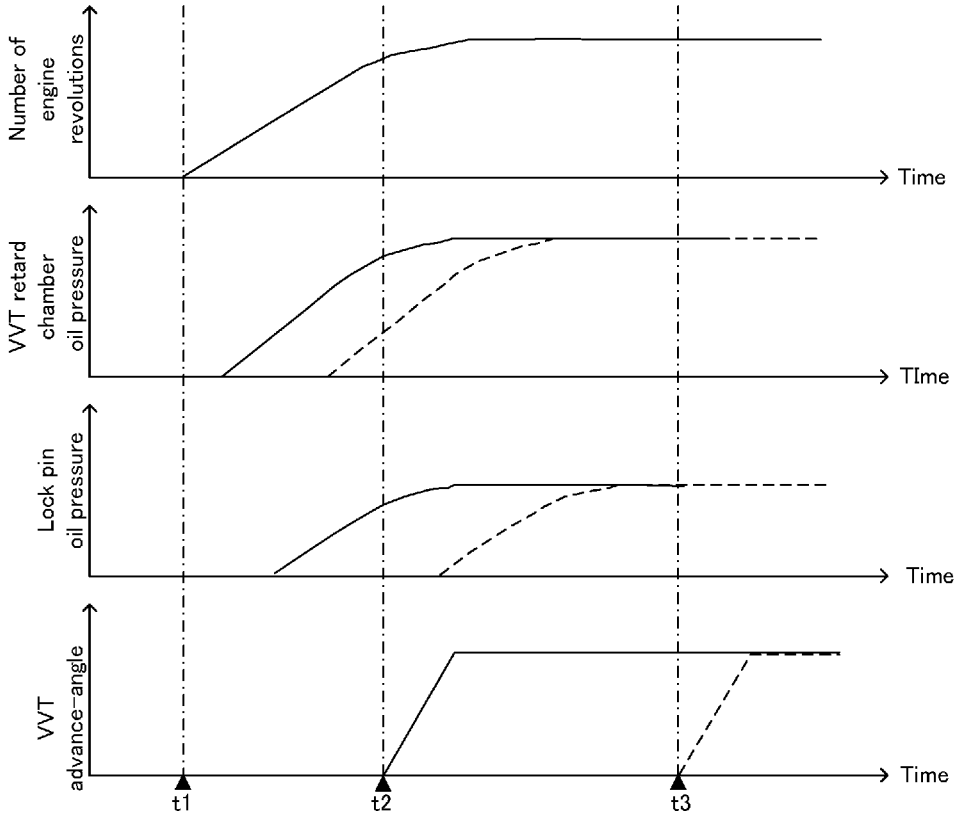
FIG. 5 is a diagram illustrating one example of time variation of the number of engine revolutions, VVT retard chamber oil pressure, and lock pin oil pressure.

Without consideration of the sharing force applied to the delay-angle lock pin (i.e. the lock pin of the locking mechanism 253 of the actuator 25), the output of the VVT advance-angle signal cannot be started until a time point at which lock pin oil pressure becomes sufficiently high (i.e. a time point t3), for example, as illustrated by a dashed line in FIG. 5.

In the valve timing control apparatus 100 in the embodiment, however, in consideration of the sharing force applied to the delay-angle lock pin, the output of the VVT advance-angle signal can be started at a time point at which the lock pin oil pressure is relatively low (i.e. a time point t2), for example, as illustrated by a solid line in FIG. 5. In other words, the output of the VVT advance-angle signal can be started relatively early, and the relative rotational phase can be changed to the advance side.

The ECU 30 may also determine an output time of the VVT advance-angle signal in consideration of a time length between the output of the VVT advance-angle signal and the actual supply of the oil pressure to the lock pin, friction, or the like.

FIG. 5 is a diagram illustrating one example of time variation of the number of engine revolutions, VVT retard chamber oil pressure, and lock pin oil pressure.

(Control Processing of Intake-Side Variable Valve Timing Mechanism)

Figure 6:
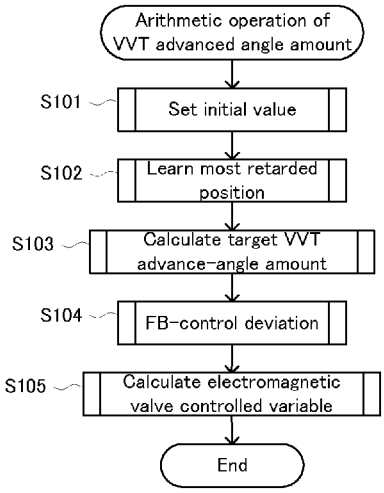
FIG. 6 is a flowchart illustrating arithmetic processing of an advance-angle amount of opening/closing timing of an intake valve.
Figure 7:
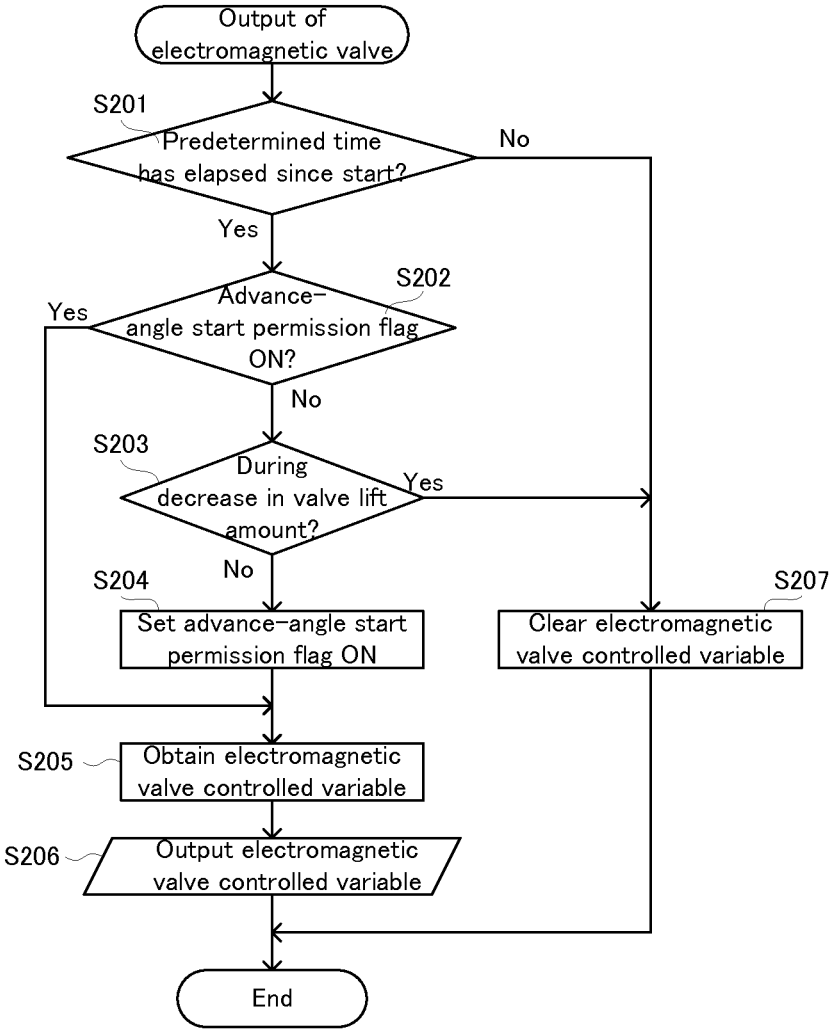
FIG. 7 is a flowchart illustrating control processing associated with an oil control valve.

Next, control processing performed on the intake-side variable valve timing mechanism by the valve timing control apparatus 100 as configured above will be explained with reference to FIG. 6 and FIG. 7. FIG. 6 is a flowchart illustrating arithmetic processing of an advance-angle amount of opening/closing timing of the intake valve 14. FIG. 7 is a flowchart illustrating control processing associated with the oil control valve 27.

In FIG. 6, the ECU 30 firstly sets an initial value associated with the opening/closing timing of the intake valve 14 (step S101). The ECU 30 then learns the most retarded position (step S102). Incidentally, various known aspects can be applied to a method of learning the most retarded position, and thus, the detailed explanation of the method is omitted.

The ECU 30 then calculates a target VVT advance-angle amount, for example, on the basis of an operating state of the engine 1 or the like (step S103). Incidentally, various known aspects can be applied to a method of calculating the target VVT advance-angle amount, and thus, the detailed explanation of the method is omitted.

The ECU 30 then obtains a difference between the calculated target VVT advance-angle amount and an actual advance-angle amount (i.e. a deviation) (step S104). The ECU 30 then calculates a controlled variable associated with the oil control valve 27 on the basis of the obtained difference (step S105). In other words, the ECU 30 feedback(FB)-controls the oil control valve 27 on the basis of the obtained difference.

In parallel with the processing illustrated in the flowchart in FIG. 6, the ECU 30 performs processing illustrated in the flowchart in FIG. 7. In FIG. 7, the ECU 30 firstly determines whether or not a predetermined time has elapsed since the start of cranking of the engine 1 (step S201). Here, the "predetermined time" may be set as, for example, a time until the lock pin oil pressure increases to the extent that the lock pin can be released if the sharing force applied to the lock pin is relatively low.

If it is determined that the predetermined time has not elapsed since the start of the cranking of the engine 1 (the step S201: No), the ECU 30 clears the controlled variable associated with the oil control valve 27 (step S207) and ends the processing once.

On the other hand, if it is determined that the predetermined time has elapsed since the start of the cranking of the engine 1 (the step S201: Yes), the ECU 30 determines whether or not an advance-angle start permission flag is ON (step S202).

If it is determined that the advance-angle start permission flag is ON (the step S202: Yes), the ECU 30 performs processing in a step S205 described later. If the advance-angle start permission flag is OFF (the step S202: No), the ECU 30 determines whether or not it is during a decrease in the valve lift amount associated with the intake valve 14 (step S203).

If it is determined that it is during the decrease in the valve lift amount associated with the intake valve 14 (the step S203: Yes), the ECU 30 determines that the sharing force applied to the retard angle lock pin is relatively high (refer to FIG. 4) and performs the processing in the step S207.

On the other hand, if it is determined that it is during an increase in the valve lift amount associated with the intake valve 14 (the step S203: No), the ECU 30 determines that the sharing force applied to the retard angle lock pin is relatively low (refer to FIG. 4) and sets the advance-angle start permission flag ON (step S204).

The ECU 30 then obtains the controlled variable associated with the oil control valve 27 calculated in the step S105 described above (step S205). The ECU 30 then outputs the obtained controlled variable associated with the oil control valve 27 to the oil control valve 27, thereby controlling the oil control valve 27 (step S206).

(Configuration of Exhaust-Side Variable Valve Timing Mechanism)

Figure 8:
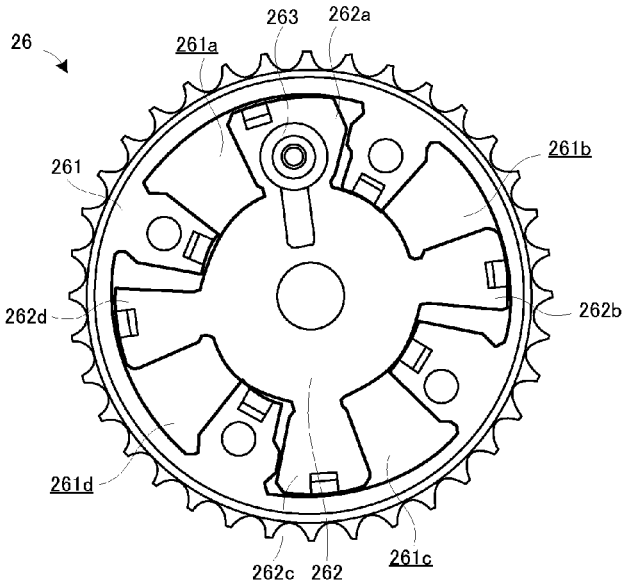
FIG. 8 is a diagram illustrating a main part of an exhaust-side variable valve timing mechanism in the embodiment.

Next, a configuration of the exhaust-side variable valve timing mechanism will be explained with reference to FIG. 8. FIG. 8 is a diagram illustrating a main part of the exhaust-side variable valve timing mechanism in the embodiment, to the same effect as that of FIG. 2.

In FIG. 8, the actuator 26 is provided with a housing 261 configured to rotate synchronously with rotation of the crankshaft (not illustrated) of the engine 1, a vane rotor 262 configured to rotate synchronously with rotation of the camshaft 23, and a locking mechanism 263 configured to engage the housing 261 and the vane rotor 262 with each other at least when the engine 1 stops.

The housing 261 has a plurality of concave parts 261*a*, 261*b*, 261*c* and 261*d* which correspond to a plurality of vanes 262*a*, 262*b*, 262*c* and 262*d* of the vane rotor 262, respectively, and which define respective movable ranges of the plurality of vanes 262*a*, 262*b*, 262*c* and 262*d*.

The oil control valve 28 controls hydraulic pressure (or the oil pressure herein) associated with a liquid chamber (specifically, an advance chamber and a retard chamber) which is formed on the side of at least one of the corresponding vanes by dividing the plurality of concave parts 261*a*, 261*b*, 261*c* and 261*d* of the housing 261 by the corresponding vanes, respectively.

The supply of the oil to the actuator 26 by the oil control valve 28 changes a relative position between the housing 261 and the vane rotor 262, resulting in a change in relative rotational phase of the camshaft 24 with respect to the crankshaft. The amount of the oil supplied to the actuator 26 from the oil control valve 28 is determined on the basis of a VVT control signal outputted from the ECU 30.

The valve timing control apparatus 100 in the embodiment is provided with the actuator 26, and the oil control valve 28.

FIG. 8 illustrates that the housing 261 and the vane rotor 262 are engaged in a state in which the plurality of vanes 262*a*, 262*b*, 262*c* and 262*d* are adjusted at the most advanced position, by the locking mechanism 263.

Figure 9:
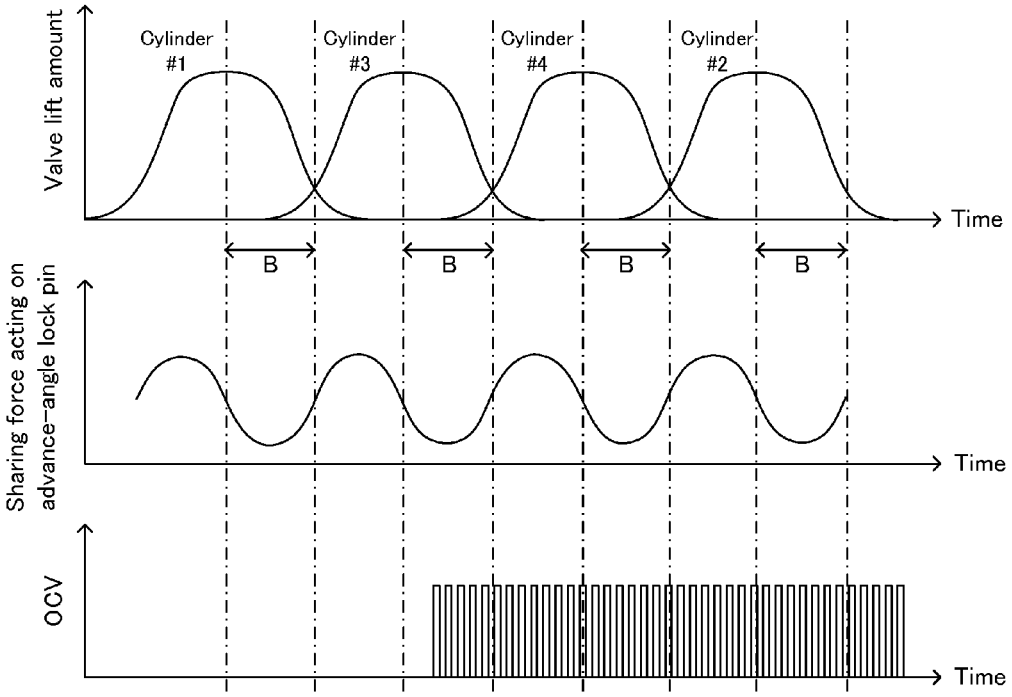
FIG. 9 is a diagram illustrating one example of time variation of a valve lift amount, and time variation of a sharing force acting on an advance-angle lock pin in the embodiment.

When the engine 1 starts, due to a cross sectional shape of the cam 22, a relation between the direction of a force applied to the cam 22 by a valve spring of the exhaust valve 16 and the direction of rotation of the camshaft 24 periodically changes. As a result, the magnitude of a sharing force applied to a lock pin of the locking mechanism 263 periodically changes, as illustrated in FIG. 9. FIG. 9 is a diagram illustrating one example of time variation of the valve lift amount, and time variation of the sharing force acting on the advance-angle lock pin in the embodiment, to the same effect as that of FIG. 4.

The sharing force applied to the advance-angle lock pin (i.e. the lock pin of the locking mechanism 263 of the actuator 26) becomes relatively large when the valve lift amount associated with the exhaust valve 16 increases, and becomes relatively small when the valve lift associated with the exhaust valve 16 decreases, as opposed to the case of the delay-angle lock pin.

The ECU 30 thus releases the lock pin when the valve lift amount decreases, and controls the oil control valve 28 to start to control the relative rotational phase of the camshaft 24 with respect to the crankshaft to the delay side. Specifically, for example, the ECU 30 starts the output of a VVT delay-angle signal (refer to the lowest part in FIG. 9) to the oil control valve 28 in any of periods B in FIG. 9.

Regarding control processing of the exhaust-side variable valve timing mechanism, the expression of "learn most retarded position" in the step S102 in the flowchart in FIG. 6 may be replaced by an expression of "learn most advanced position", and the expression of "calculate target VVT advance-angle amount" in the step S103 may be replaced by an expression of "calculate target VVT delay-angle". In the same manner, the expression of "advance-angle start permission flag ON?" in the step S202 in FIG. 7 may be replaced by an expression of "delay-angle start permission flag ON?", the expression of "during decrease in valve lift amount?" in the step S203 may be replaced by an expression of "during increase in valve lift amount?", and the expression of "set advance-angle start permission flag ON" in the step S204 may be replaced by an expression of "set retarded start permission flag ON".

The "vane rotor 252" and the "vane rotor 262" in the embodiment are one example of the "first rotating body" of the present invention. The "housing 251" and the "housing 261" in the embodiment are one example of the "second rotating body" of the present invention. The "oil control valve 27" and the "oil control valve 28" in the embodiment are one example of the "rotational phase changing device" of the present invention. The "ECU 30" in the embodiment is one example of the "advance-angle control starting device" and the "delay-angle control starting device" of the present invention.

The embodiment shows one example of the sharing force applied to each of the delay-angle lock pin and the sharing force in a four-cylinder engine. If the number of cylinders increases, such as, for example, six cylinders and eight cylinders, then, the length of the period A in FIG. 4 and the length of the period B in FIG. 9 are only shortened, and there is no change in the aforementioned control itself.

The present invention is not limited to the aforementioned embodiment, but various changes may be made, if desired, without departing from the essence or spirit of the invention which can be read from the claims and the entire specification. A valve timing control apparatus, which involves such changes, is also intended to be within the technical scope of the present invention.

DESCRIPTION OF REFERENCE NUMERALS

1 engine
11 cylinder
12 piston
13 intake passage
14 intake valve
15 exhaust passage
16 exhaust valve
21, 22 cam
23, 24 camshaft
25, 26 actuator
27, 28 oil control valve

30 ECU
100 valve timing control apparatus
251, 261 housing
252, 262 vane rotor
253, 263 locking mechanism

The invention claimed is:

1. A valve timing control apparatus comprising:

a first rotating body configured to rotate synchronously with rotation of a camshaft which drives opening/closing of at least one of an intake valve and an exhaust valve of an internal combustion engine, and having a plurality of vanes;

a second rotating body configured to rotate synchronously with rotation of a crankshaft of the internal combustion engine, and having a plurality of concave parts which correspond to the plurality of vanes, respectively, and which define respective movable ranges of the plurality of vanes;

a locking mechanism configured to engage the first rotating body and the second rotating body with each other such that each of the plurality of vanes is in contact with one end of respective one of the concave parts, at least when the internal combustion engine stops; and a rotational phase changing device configured to control hydraulic pressure associated with a liquid chamber which is formed on a side of at least one of the corresponding vanes by dividing the plurality of concave parts by the corresponding vanes, respectively, thereby changing a relative rotational phase of the camshaft with respect to the crankshaft, said valve timing control apparatus further comprising at least one of:

an advance-angle control starting device configured to obtain a valve lift amount associated with the intake valve or the exhaust valve when the internal combustion engine starts, and to control the locking mechanism so as to release the engagement between the first rotating body and the second rotating body and to start to control the rotational phase changing device so as to the relative rotational phase to an advance side by controlling the hydraulic pressure if the obtained valve lift amount increases; and a delay-angle control starting device configured to obtain the valve lift amount associated with the intake valve or the exhaust valve when the internal combustion engine starts, and to control the locking mechanism so as to release the engagement between the first rotating body and the second rotating body and to start to control the rotational phase changing device so as to the relative rotational phase to a delay side by controlling the hydraulic pressure if the obtained valve lift amount decreases.

2. The valve timing control apparatus according to claim 1, wherein the locking mechanism engages the first rotating body and the second rotating body with each other such that each of the plurality of vanes is in contact with one end of respective one of the concave parts, as a most delayed position, at least when the internal combustion engine stops, and said valve timing control apparatus comprises the advance-angle control starting device.

3. The valve timing control apparatus according to claim 1, wherein the locking mechanism engages the first rotating body and the second rotating body with each other such that each of the plurality of vanes is in contact with one end of respective one of the concave parts, as a most advanced position, at least when the internal combustion engine stops, and said valve timing control apparatus comprises the delay-angle control starting device.

* * * * *